US007670663B2

(12) United States Patent
Poulakis

(10) Patent No.: US 7,670,663 B2
(45) Date of Patent: Mar. 2, 2010

(54) FLAME-RESISTANT CLOSURE

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 0 days.

(21) Appl. No.: 12/087,662

(22) PCT Filed: Nov. 30, 2006

(86) PCT No.: PCT/EP2006/011477

§ 371 (c)(1),
(2), (4) Date: Jul. 11, 2008

(87) PCT Pub. No.: WO2007/082570

PCT Pub. Date: Jul. 26, 2007

(65) Prior Publication Data

US 2009/0036013 A1 Feb. 5, 2009

(30) Foreign Application Priority Data

Jan. 18, 2006 (DE) ..... 10 2006 002 339
Jan. 18, 2006 (DE) ..... 20 2006 002 409 U

(51) Int. Cl.
*B32B 3/06* (2006.01)
*D03D 27/00* (2006.01)

(52) U.S. Cl. ..... 428/100; 428/99; 139/384 R; 139/391

(58) Field of Classification Search ..... 428/93, 428/92, 99, 100; 442/136, 143, 147
See application file for complete search history.

(56) References Cited

U.S. PATENT DOCUMENTS

| | | | | |
|---|---|---|---|---|
| 4,824,709 | A | 4/1989 | Tschirch | |
| 7,351,464 | B2 * | 4/2008 | Poulakis | 428/93 |
| 2004/0166282 | A1 | 8/2004 | Kingsford et al. | |

FOREIGN PATENT DOCUMENTS

| | | |
|---|---|---|
| DE | 102 40 986 B3 | 2/2004 |
| DE | 697 20 461 T2 | 2/2004 |
| DE | 11 2004 001 562 T5 | 7/2006 |
| EP | 0 198 182 | 9/1988 |

(Continued)

OTHER PUBLICATIONS

C. Löffler and R. Wingenbach, Beschichtete Gewebe—ein Beitrag zur Flammfestausrüstung. In: Coating. ISSN: 0590-8450, 1979, Heft 10, S. 275-278.

(Continued)

*Primary Examiner*—Lynda Salvatore
(74) *Attorney, Agent, or Firm*—Roylance, Abrams, Berdo & Goodman, L.L.P.

(57) ABSTRACT

A flame-resistant closure includes at least one closing part having at least one two-dimensional backing fabric (14) of warp threads (10) and weft threads (12) and having functional threads (16) on the right side of the backing fabric (14). The functional threads at least partially extend through the backing fabric (14), and form the closing elements (18). The backing fabric (14) is of the non-flame-resistant type. At least some sections of the backing fabric reverse side include a substrate layer (32) with a substantially inflammable medium and/or with an active extinguishing medium. This closure meets even high demands on inflammability.

34 Claims, 1 Drawing Sheet

FOREIGN PATENT DOCUMENTS

| | | | |
|---|---|---|---|
| EP | 0 883 354 | B1 | 12/1998 |
| EP | 1 275 381 | A1 | 1/2003 |
| EP | 1 486 606 | A1 | 12/2004 |
| WO | WO 97/31549 | | 9/1997 |
| WO | WO 03/044266 | A2 | 5/2003 |
| WO | WO 2005/017060 | A1 | 2/2005 |

OTHER PUBLICATIONS

Jürgen Troitzsch, Brandverhalten von Kunststoffen: Grundlagen-Vorschriften Prüfverfahren, 1. Aufl. München, Hanser, 1981, Kap. 5.1. ISBN:3-446-13391-7.

* cited by examiner

FLAME-RESISTANT CLOSURE

FIELD OF THE INVENTION

The present invention relates to a flame-resistant closure in the manner of a fastening system comprising a two-dimensional hook and loop closure part. The closure elements corresponding to one another can be caused to detachably engage. Fastening systems such as these have also become known under the trademark name Velcro or Velcro hook and loop closures.

BACKGROUND OF THE INVENTION

Woven hook and loop closure parts, whose warp, weft, and functional threads may be formed of textile fibers. Plastic or metal fibers are also readily available on the market in a host of embodiments. The functional threads in the backing fabric of warp and weft threads form loop-shaped interlocking elements, provided they are formed from multifilament threads. If the functional threads are formed from monofilament fibers, these closed loops are cut apart or thermally separated from one another to form closure hooks which can be caused to engage the correspondingly made fleece loop material of the other closure part of the fastening system. Closures such as these are characterized by recurring potential opening and closing processes.

Fastening systems such as these are increasingly being used in transportation and aircraft engineering, for example, for attachment of wall panels to the carrier structure of a railway car or for attaching seat covering materials to aircraft passenger seats or the like. Especially in the area of aeronautic engineering increased demands are imposed at present on these fastening systems for low flammability. These demands are much stricter than earlier specifications, for example, in the form of EADS Specification FAR25.853(b).

To satisfy that regulation, for example, EP-A-1 275 381 proposes coating a hook and loop closure part having closure elements with a flame retardant medium on the surface side and/or incorporating the pertinent flame-retardant medium into the closure itself. As the coating method, for example, an immersion process is suggested, with the flame-retardant media substances and substance groups being such as phosphorus, graphite, nitrogen and antimony compounds and aluminum derivatives and hydrates. Furthermore, the use of organic phosphorus substances is described. For better joining of the flame-retardant medium to the closure material, the use of a binder, for example, in the form of vinyl acetate, is proposed. Although the known closure on its top can be completely surrounded by the flame-retardant medium, or at least is formed partially of the flame-retardant medium itself, these measures are not currently adequate to meet the more stringent flame protection guidelines.

EP-B-0 883 354 discloses a flame-retardant fastening element which, as part of a fastening system for detachable engagement, is matched to a second fastening element having a substrate layer of a flame-retardant polymer material into which U-shaped clamps are placed. The legs of the clamps form stem sections which on their free end and projecting from the substrate layer each form a closure head. The closure elements formed in this way as closure mushrooms are securely anchored in the substrate layer on the base side by the clamp crosspiece. For attaching the fastening element to outside parts such as vehicle components or the like, a non-flame-retardant, pressure-sensitive cement is used and applied to a support surface facing away from the top of the substrate layer with the projecting fastening heads as part of the fastening element. In the known solution, for one preferred embodiment the non-flame-retardant, pressure-sensitive cement is a foam layer of a pressure-sensitive acrylic foam cement. Cements with this structure are detailed, for example, in WO-A-2005/017060. This solution forms a flame-retardant closure with very good action, but can be expensive in implementation, especially with respect to placing the U-shaped fastening elements in the substrate layer.

In addition to using conventional plastic materials as cited above in the form of polyethylene, polyamide or the like for the closure material, EP-B-0 198 182 discloses the use of carbon fiber materials for implementation of a flame-retardant closure. In this known solution, with the formation of a flame-retardant closure both the loops and the backing material of the loop part as the backing fabric from which the loops project are formed of carbon fibers. The hooks of the hook part itself should be formed from wire. Although in the known solution both the loop part and also the hook part have a textile character so that they can be processed like conventional textile hook and loop closures, in particular sewn on, their flame resistance far exceeds that of textile hook and loop closures of the conventional type, specifically 1,000° C. The use of carbon fiber materials has, however, proven very costly, since carbon material is only available to a limited degree, at least for the present.

SUMMARY OF THE INVENTION

An object of the present invention is to provide an improved flame-retardant closure which meets increased requirements for low flammability and which can be economically produced.

This object is basically achieved by a flame-retardant closure where at least one closure part has at least one two-dimensional backing fabric formed from warp threads and weft threads and has functional threads projecting on the front of the backing fabric. The functional threads are parts of the backing fabric, extend at least partially through it and form the closure elements. The backing fabric is of a non-flame-retardant type. The fabric back has at least partially a substrate layer with a medium of low flammability and/or with an active extinguishing medium. To form the flame-retardant closure according to the present invention, a conventional closure element is used as is disclosed, for example, in DE-B-102 40 986 of the applicant. This standard closure part is made of conventional plastic materials, for example, of polypropylene or polyamide material which can be considered rather heat-sensitive. This product is a standard industrial product produced in very large amounts and is reliably and economically available. This standard closure part, for the purposes of the present invention, is joined to a special substrate layer which is either flame-retardant and/or which preferably has an active extinguishing substance. Regardless of the size, especially the thickness of the actual closure part, the substrate layer medium applied to the back in terms of its volume can be chosen such that adequate low flammability or extinguishing safety is ensured. Even under restricted space conditions, the closure can be easily attached, for example, when covering materials must be fixed on cushion materials of aircraft passenger seats or the like. The thickness of the substrate with the respective medium can correspond to the overall height of the closure part including the backing fabric and closure elements, but also can be a multiple thereof.

In one especially preferred embodiment of the flame-retardant closure according to the present invention, the substrate layer is connected to the backing fabric by an adhesive layer. Preferably, the backing fabric has a finish ensuring fixing of the backing fabric with the individual threads. To provide good further processing capacity of the closure, in one preferred embodiment the substrate layer on its side facing away from the backing fabric has a connecting part. This connecting part can be made as a woven or non-woven material, and allows a good connection of the closure to outside parts such as cushion covering materials or cushion foam parts.

Surprising to one with average skill in the art in the field of fastening systems and closure parts, a commercial closure part can be used for a low-flammability closure, and can satisfy the increased flame resistance criteria as are listed, for example, in Specification AIMS 04-19-002 (January 2005 edition) of Airbus S. A. S. with the title: Hook and loop tape, non self-adhesive flame propagation resistant; Material Specification. The closure according to the present invention can be economically implemented by using standard products for closure parts.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not drawn to scale.

DETAILED DESCRIPTION OF THE INVENTION

Figure 1:
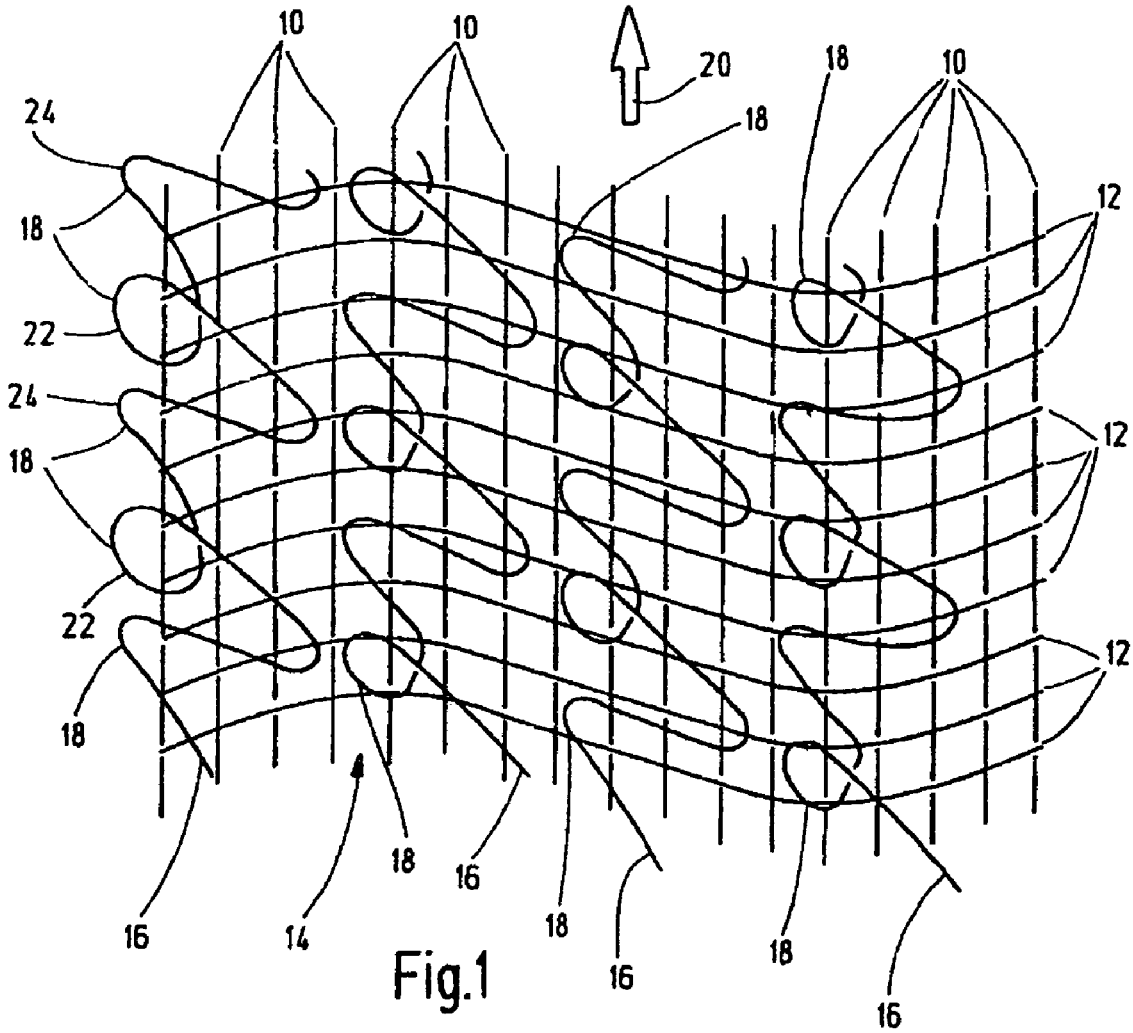
FIG. 1 is a top plan view of a hook and loop closure part according to one exemplary embodiment of the present invention.

FIG. 1 shows by an extract a top view of a two-dimensional hook and loop closure part which can be optionally lengthened within the plane of the figure in both directions or either direction of the figure. The geometrical dimensions of the sheet article are dependent on the specifications of the weaving means on which the hook and loop closure part is made. Especially for later use, these closure parts are manufactured as hook and loop closure strips wound into rolls (not shown). The closure part includes warp threads 10 and weft threads 12 woven in a transverse arrangement to one another to form the backing fabric 14 for the hook and loop closure part. The backing fabric 14 is provided with functional threads 16 in the manner of pile threads to form a further part of the backing fabric. The functional threads 16 form the individual closure elements 18 for the two-dimensional hook and loop closure part.

Viewed in the direction of FIG. 1, on its top the production direction for the hook and loop closure part is shown by the arrow 20. In the illustrated arrangement shown in FIG. 1, the respective weft threads 12 are made arc-shaped in the manner of sine or cosine waves. At the crossing sites between the warp threads 10 and weft threads 12 the warp threads 10 run or extend parallel to the production direction 20 and parallel to one another in a straight-line arrangement. In the embodiment shown in FIG. 1, only the warp threads 12 are arranged to run or extend in an arc shape in the backing fabric 14. The respective weft threads 12 in an alternating sequence overlap the warp thread 12 and extending under the one directly following in the row. The advantages of this arc-shaped configuration are detailed in DE-B-102 40 986 of the applicant (corresponding to U.S. Pat. No. 7,351,464) so that it will no longer be detailed here.

At the site at which it extends underneath the backing fabric, each functional thread 16 forms an overlying loop 22. Another loop 24 is formed directly following so that a type of V-weave is implemented. Other types of weave are also conceivable, for example, wrapping the functional thread in a W-shaped manner or the like.

The loops 22, 24 form the closure element 18 and the loops 22, 24 remain closed, as shown. A type of fleece hook and loop closure part is formed, where hook-like or mushroom-like closure elements can engage these loops 22, 24 to obtain a detachable hook and loop closure as the closure system or fastening system. The loops 22, 24 can also be cut open to form a closure hook (not shown) which can be interlocked with the corresponding nonwoven or fleece material of another closure part which is not detailed as the first closure part.

Figure 2:
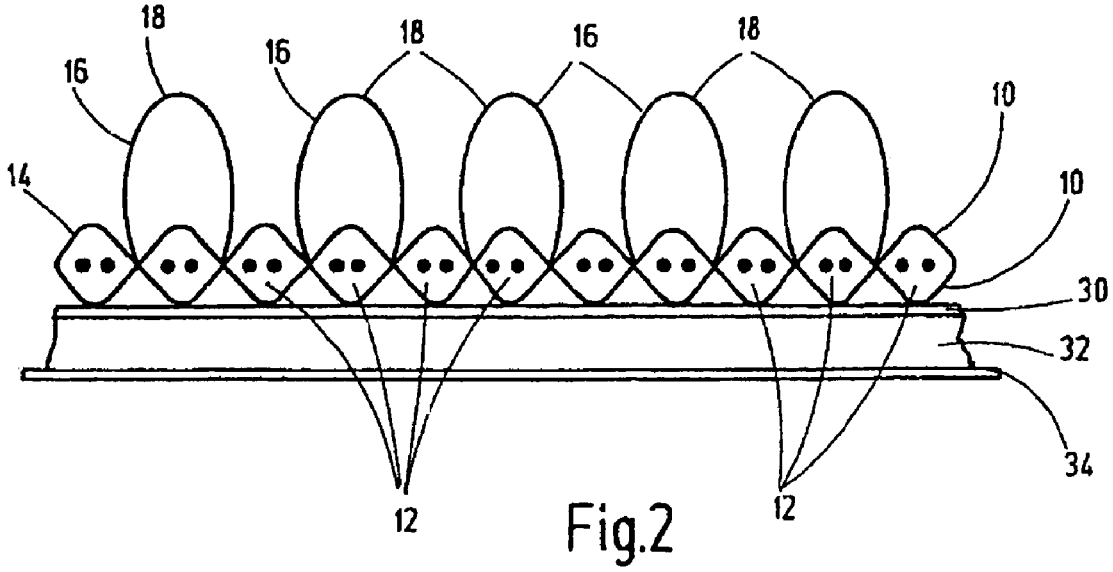
FIG. 2 is a side view of the flat hook and loop closure part of FIG. 1.

As shown in particular in FIG. 2, an individual weft thread 12 can also include a pair of weft threads or can be multifilament. This multiple of threads also applies to warp threads 10 which, according to the cross section of front view shown in FIG. 2, in an alternating sequence each warp thread overlaps one pair of weft threads 12 of the second closure part in order to subsequently extend under this pair of weft threads 12. The respective functional or pile thread 16 overlaps the two succeeding weft thread pairs 12 in each row with omission of one respective pair of weft threads 12. On the backing fabric 14, the loops of the first type 22 and of the other type 23 are arranged offset to one another. The loops of the first type 22 form essentially closed, O-shaped loops. The loops of the second type 24 are made V-shaped or U-shaped. A repeat pattern for one functional thread 16 of the second closure part is repeated in the direction of the weft threads 12 after five warp threads 10. The thread systems can be formed of textile fibers, but preferably they are formed from a plastic material, especially nylon or polypropylene material. This material choice already makes it clear that the backing fabric 14 with the closure elements 18 is highly flammable, that is, of the non-flame-retardant type.

To attain a poorly flammable or flame-retardant closure at this point, the closure part as shown in FIG. 1 is accordingly provided with a substrate layer shown in the cross section in FIG. 2. The scale ratios shown in FIG. 2 are not entirely appropriate to be able to clearly reproduce the layer structure to the viewer. Furthermore, it should be emphasized that the structure of a closure part shown in FIG. 1 constitutes only one possible fabric implementation and that a flame-retardant closure with a plurality of backing fabric structures for a closure part in addition to functional and pile threads could be implemented. The embodiment as shown in FIGS. 1 and 2 therefore is of a rather exemplary nature.

To fix the backing fabric 14 with its individual threads and thread systems, it is intended that they be provided with a finish, preferably a polyurethane finish (PUR). This finish structure is conventional, and is accordingly not detailed in FIG. 2. Underneath the backing fabric 14 with its PUR finish, an adhesive layer 30 is provided which need not be pressure-sensitive, and preferably made in the form of a reactive polyurethane cement itself need not be flame-retardant either. Underneath the adhesive layer 30 of adhesive is a substrate layer 32 preferably covering the entire understructure of the backing fabric 14. The thickness or the height of the structure can essentially correspond to the thickness or the height of the structure of the backing fabric 14.

This substrate layer 32 preferably is formed of a low-flammability material, or is provided with an active extinguishing medium. The two material properties can also be achieved with a substrate layer 32. In particular the low-flammability material for the substrate layer 32 can be selected from the following groups of substances:

ammonium phosphate (AP)
ammonium polyphosphate (APP)
resorcinol bis-diphenyl phosphate (PDP)
red phosphorus (RP)
tri-n-butyl phosphate (TBP)
tricresyl phosphate (TCP)
triphenyl phosphate (TPP).

The active extinguishing medium can preferably be an extinguishing gas like nitrogen or an extinguishing fluid like water. The nitrogen vehicle here can be especially melamine. The active extinguishing medium for the delivery of water can be aluminum trihydroxide (ATH) or magnesium hydroxide (MDH). Preferably, the substrate layer 32 additionally or alternatively can contain nanoparticles such as silicates or graphite which likewise have very good extinguishing properties. If in one preferred embodiment the substrate layer 32 is formed of ammonium polyphosphates (APP), under the action of heat it can form an effective extinguishing foam which stops the supply of air in the direction of the backing fabric 14 with its closure elements 18 and in this way smothers a flame or fire and effectively stops it in this way. The substrate layer 32 then has intumescing properties.

For a low-flammability closure no harmful extinguishing agents or harmful substances are used. Accordingly, care is taken so that the low-flammability medium used is free of halogens, free of antimony and free of formaldehyde. If for special reasons the closure part should be ignitable, other protective mechanisms would be conceivable, for example, to replace some of the threads by carbon yarn or the like. Furthermore, as shown in the prior art (EP-A-1 275 318), it would be possible to provide the closure part or parts thereof such as the closure elements with a low-flammability medium by coating.

As is further shown in FIG. 2, viewed in the direction of FIG. 2, underneath the substrate layer 32 an additional connecting component 34 can be applied two-dimensionally. It can be made as a non-woven or woven material, and is especially preferably a polyester nonwoven. With this polyester nonwoven especially preferably the joining of the overall closure system to other third carrier components which are not detailed takes place, for example, in the form of a cushion covering material or cushion material on an aircraft passenger seat.

While one embodiment has been chosen to illustrate the invention, it will be understood by those skilled in the art that various changes and modifications can be made therein without departing from the scope of the invention as defined in the appended claims.

What is claimed is:

1. A flame-resistant closure, comprising:

at least one closure part with at least one two-dimensional backing fabric of warp threads and weft threads, said backing fabric being non-flame-retardant;

functional threads projecting on a front of said backing fabric, extending at least partially through said backing fabric and forming closure elements;

a substrate layer on a back of said backing fabric having at least one of a low-flammability medium and an active extinguishing medium; and a finish on said backing fabric.

2. A flame-resistant closure according to claim 1 wherein said finish is a polyurethane finish.

3. A flame-resistant closure according to claim 1 wherein an adhesive layer joins said substrate layer to said backing fabric.

4. A flame-resistant closure according to claim 1 wherein a connecting component is on a side of said substrate layer facing away from said backing fabric.

5. A flame-resistant closure according to claim 4 wherein said connecting component is a polyester nonwoven connecting component.

6. A flame-resistant closure according to claim 1 wherein said substrate layer is formed of a material selected from the group consisting of ammonium phosphate (AP), ammonium polyphosphate (APP), aluminum hydroxide (ATH), magnesium hydroxide (MDH), resorcinol bis-diphenyl phosphate (PDP), red phosphorus (RP), tri-n-butyl phosphate (TBP), tricresyl phosphate (TCP), riphenyl phosphate (TPP) and melamine.

7. A flame-resistant closure according to claim 1 wherein said substrate layer contains said active extinguishing medium, said active extinguishing medium containing at least one of extinguishing gas and extinguishing fluid.

8. A flame-resistant closure according to claim 7 wherein said extinguishing medium is an extinguishing gas, said extinguishing gas being nitrogen.

9. A flame-resistant closure according to claim 7 wherein said extinguishing medium is an extinguishing fluid, said extinguishing fluid being water.

10. A flame-resistant closure according to claim 1 wherein said substrate layer contains nanoparticles.

11. A flame-resistant closure according to claim 10 wherein said nanoparticles comprise at least one of silicates and graphite.

12. A flame-resistant closure according to claim 1 wherein said substrate layer forms said active extinguishing medium in response to heat.

13. A flame-resistant closure, comprising:

at least one closure part with at least one two-dimensional backing fabric of warp threads and weft threads, said backing fabric being non-flame-retardant;

functional threads projecting on a front of said backing fabric, extending at least partially through said backing fabric and forming closure elements;

a substrate layer on a back of said backing fabric having at least one of a low-flammability medium and an active extinguishing medium; and a connecting component on a side of said substrate layer facing away from said backing fabric.

14. A flame-resistant closure according to claim 13 wherein a polyurethane finish is on said backing fabric.

15. A flame-resistant closure according to claim 13 wherein an adhesive layer joins said substrate layer to said backing fabric.

16. A flame-resistant closure according to claim 13 wherein said connecting component is a polyester nonwoven connecting component.

17. A flame-resistant closure according to claim 13 wherein said substrate layer is formed of a material selected from the group consisting of ammonium phosphate (AP), ammonium polyphosphate (APP), aluminum hydroxide (ATH), magnesium hydroxide (MDH), resorcinol bis-diphenyl phosphate (PDP), red phosphorus (RP), tri-n-butyl phosphate (TBP), tricresyl phosphate (TCP), riphenyl phosphate (TPP) and melamine.

18. A flame-resistant closure according to claim 13 wherein said substrate layer contains said active extinguishing medium, said active extinguishing medium containing at least one of extinguishing gas and extinguishing fluid.

19. A flame-resistant closure according to claim 18 wherein said extinguishing medium is an extinguishing gas, said extinguishing gas being nitrogen.

20. A flame-resistant closure according to claim 18 wherein said extinguishing medium is an extinguishing fluid, said extinguishing fluid being water.

21. A flame-resistant closure according to claim 13 wherein said substrate layer contains nanoparticles.

22. A flame-resistant closure according to claim 21 wherein said nanoparticles comprise at least one of silicates and graphite.

23. A flame-resistant closure according to claim 13 wherein said substrate layer forms said active extinguishing medium in response to heat.

24. A flame-resistant closure, comprising:

at least one closure part with at least one two-dimensional backing fabric of warp threads and weft threads, said backing fabric being non-flame-retardant;

functional threads projecting on a front of said backing fabric, extending at least partially through said backing fabric and forming closure elements; and a substrate layer on a back of said backing fabric containing an active extinguishing medium with at least one of extinguishing gas and extinguishing fluid.

25. A flame-resistant closure according to claim 24 wherein a polyurethane finish is on said backing fabric.

26. A flame-resistant closure according to claim 24 wherein an adhesive layer joins said substrate layer to said backing fabric.

27. A flame-resistant closure according to claim 24 wherein a connecting component is on a side of said substrate layer facing away from said backing fabric.

28. A flame-resistant closure according to claim 27 wherein said connecting component is a polyester nonwoven connecting component.

29. A flame-resistant closure according to claim 24 wherein said substrate layer is formed of a material selected from the group consisting of ammonium phosphate (AP), ammonium polyphosphate (APP), aluminum hydroxide (ATH), magnesium hydroxide (MDH), resorcinol bis-diphenyl phosphate (PDP), red phosphorus (RP), tri-n-butyl phosphate (TBP), tricresyl phosphate (TCP), triphenyl phosphate (TPP) and melamine.

30. A flame-resistant closure according to claim 24 wherein said extinguishing medium is an extinguishing gas, said extinguishing gas being nitrogen.

31. A flame-resistant closure according to claim 24 wherein said extinguishing medium is an extinguishing fluid, said extinguishing fluid being water.

32. A flame-resistant closure according to claim 23 wherein said substrate layer contains nanoparticles.

33. A flame-resistant closure according to claim 32 wherein said nanoparticles comprise at least one of silicates and graphite.

34. A flame-resistant closure according to claim 24 wherein said substrate layer forms said active extinguishing medium in response to heat.

* * * * *